US008828110B2

(12) United States Patent
Frushour

(10) Patent No.: US 8,828,110 B2
(45) Date of Patent: Sep. 9, 2014

(54) ADNR COMPOSITE

(76) Inventor: Robert Frushour, Ann Arbor, MI (US)

( * ) Notice: Subject to any disclaimer, the term of this patent is extended or adjusted under 35 U.S.C. 154(b) by 359 days.

(21) Appl. No.: 13/241,906

(22) Filed: Sep. 23, 2011

(65) Prior Publication Data

US 2012/0292118 A1 Nov. 22, 2012

Related U.S. Application Data

(60) Provisional application No. 61/488,408, filed on May 20, 2011.

(51) Int. Cl.
*B24B 3/00* (2006.01)

(52) U.S. Cl.
USPC ..... 51/307; 51/293

(58) Field of Classification Search
USPC ..... 51/293, 307
See application file for complete search history.

(56) References Cited

U.S. PATENT DOCUMENTS

| | | | |
|---|---|---|---|
| 2,238,351 | A | 4/1941 | Van Der Pyl |
| 2,941,248 | A | 6/1960 | Hall |
| 3,083,080 | A | 3/1963 | Bovenkerk |
| 3,134,739 | A | 5/1964 | Cannon |
| 3,136,615 | A | 6/1964 | Bovenkerk et al. |
| 3,141,746 | A | 7/1964 | De Lai |
| 3,233,988 | A | 2/1966 | Wentorf, Jr. et al. |
| 3,297,407 | A | 1/1967 | Wentorf, Jr. |
| 3,423,177 | A | 1/1969 | Bovenkerk |
| 3,574,580 | A | 4/1971 | Stromberg et al. |
| 3,745,623 | A | 7/1973 | Wentorf, Jr. et al. |
| 4,034,066 | A | 7/1977 | Strong et al. |
| 4,042,673 | A | 8/1977 | Strong |
| 4,073,380 | A | 2/1978 | Strong et al. |
| 4,108,614 | A | 8/1978 | Mitchell |
| 4,124,690 | A | 11/1978 | Strong et al. |
| 4,151,686 | A | 5/1979 | Lee et al. |
| 4,224,380 | A | 9/1980 | Bovenkerk et al. |
| 4,247,304 | A | 1/1981 | Morelock |
| 4,255,165 | A | 3/1981 | Dennis et al. |
| 4,268,276 | A | 5/1981 | Bovenkerk |
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,412,980 | A | 11/1983 | Tsuji et al. |
| 4,481,016 | A | 11/1984 | Campbell et al. |
| 4,486,286 | A | 12/1984 | Lewin et al. |
| 4,504,519 | A | 3/1985 | Zelez |
| 4,522,633 | A | 6/1985 | Dyer |
| 4,525,179 | A | 6/1985 | Gigl |
| 4,534,773 | A | 8/1985 | Phaal et al. |
| 4,556,407 | A | 12/1985 | Fecik et al. |
| 4,560,014 | A | 12/1985 | Geczy |
| 4,570,726 | A | 2/1986 | Hall |
| 4,572,722 | A | 2/1986 | Dyer |
| 4,604,106 | A | 8/1986 | Hall |
| 4,605,343 | A | 8/1986 | Hibbs, Jr. et al. |
| 4,606,738 | A | 8/1986 | Hayden |
| 4,621,031 | A | 11/1986 | Scruggs |
| 4,636,253 | A | 1/1987 | Nakai et al. |
| 4,645,977 | A | 2/1987 | Kurokawa et al. |
| 4,662,348 | A | 5/1987 | Hall et al. |
| 4,664,705 | A | 5/1987 | Horton et al. |
| 4,707,384 | A | 11/1987 | Schachner et al. |
| 4,726,718 | A | 2/1988 | Meskin et al. |
| 4,766,040 | A | 8/1988 | Hillert et al. |
| 4,776,861 | A | 10/1988 | Frushour |
| 4,792,001 | A | 12/1988 | Zijsling |
| 4,793,828 | A | 12/1988 | Burnand |
| 4,797,241 | A | 1/1989 | Peterson et al. |
| 4,802,539 | A | 2/1989 | Hall et al. |
| 4,807,402 | A | 2/1989 | Rai |
| 4,828,582 | A | 5/1989 | Frushour |
| 4,844,185 | A | 7/1989 | Newton, Jr. et al. |
| 4,861,350 | A | 8/1989 | Phaal et al. |
| 4,871,377 | A | 10/1989 | Frushour |
| 4,899,922 | A | 2/1990 | Slutz et al. |
| 4,919,220 | A | 4/1990 | Fuller et al. |
| 4,940,180 | A | 7/1990 | Martell |
| 4,943,488 | A | 7/1990 | Sung et al. |
| 4,944,772 | A | 7/1990 | Cho |
| 4,976,324 | A | 12/1990 | Tibbitts |
| 5,011,514 | A | 4/1991 | Cho et al. |
| 5,027,912 | A | 7/1991 | Juergens |
| 5,030,276 | A | 7/1991 | Sung et al. |
| 5,092,687 | A | 3/1992 | Hall |
| 5,116,568 | A | 5/1992 | Sung et al. |
| 5,127,923 | A | 7/1992 | Bunting et al. |
| 5,133,332 | A | 7/1992 | Tanaka et al. |
| 5,135,061 | A | 8/1992 | Newton, Jr. |
| 5,176,720 | A | 1/1993 | Martell et al. |
| 5,186,725 | A | 2/1993 | Martell et al. |

(Continued)

FOREIGN PATENT DOCUMENTS

| | | | |
|---|---|---|---|
| EP | 061954 | A1 | 12/1980 |
| EP | 0300699 | A2 | 1/1989 |

(Continued)

*Primary Examiner* — Pegah Parvini

(74) *Attorney, Agent, or Firm* — Young, Basile, Hanlon & MacFarlane P.C.

(57) ABSTRACT

A composite body has a material layer formed from aggregated diamond nanorods (ADNRs); The ADNR material layer has a first surface and a substrate. The first surface of the diamond material layer and the substrate are bonded together under high pressure and high temperature.

13 Claims, 1 Drawing Sheet

(56) References Cited

U.S. PATENT DOCUMENTS

| | | | |
|---|---|---|---|
| 5,199,832 | A | 4/1993 | Meskin et al. |
| 5,205,684 | A | 4/1993 | Meskin et al. |
| 5,213,248 | A | 5/1993 | Horton et al. |
| 5,236,674 | A | 8/1993 | Frushour |
| 5,238,074 | A | 8/1993 | Tibbitts et al. |
| 5,244,368 | A | 9/1993 | Frushour |
| 5,264,283 | A | 11/1993 | Waldenstrom et al. |
| 5,337,844 | A | 8/1994 | Tibbitts |
| 5,370,195 | A | 12/1994 | Keshavan et al. |
| 5,379,853 | A | 1/1995 | Lockwood et al. |
| 5,439,492 | A | 8/1995 | Anthony et al. |
| 5,451,430 | A | 9/1995 | Anthony et al. |
| 5,464,068 | A | 11/1995 | Najafi-Sani |
| 5,468,268 | A | 11/1995 | Tank et al. |
| 5,496,638 | A | 3/1996 | Waldenstrom et al. |
| 5,505,748 | A | 4/1996 | Tank et al. |
| 5,510,193 | A | 4/1996 | Cerutti et al. |
| 5,523,121 | A | 6/1996 | Anthony et al. |
| 5,524,719 | A | 6/1996 | Dennis |
| 5,560,716 | A | 10/1996 | Tank et al. |
| 5,607,024 | A | 3/1997 | Keith et al. |
| 5,620,382 | A | 4/1997 | Cho et al. |
| 5,624,068 | A | 4/1997 | Waldenstrom et al. |
| 5,667,028 | A | 9/1997 | Truax et al. |
| 5,672,395 | A | 9/1997 | Anthony et al. |
| 5,718,948 | A | 2/1998 | Ederyd et al. |
| 5,722,499 | A | 3/1998 | Nguyen et al. |
| 5,776,615 | A | 7/1998 | Wong et al. |
| 5,833,021 | A | 11/1998 | Mensa-Wilmot et al. |
| 5,855,996 | A | 1/1999 | Corrigan et al. |
| 5,897,942 | A | 4/1999 | Karner et al. |
| 5,921,500 | A | 7/1999 | Ellis et al. |
| 5,954,147 | A | 9/1999 | Overstreet et al. |
| 5,981,057 | A | 11/1999 | Collins |
| 6,009,963 | A | 1/2000 | Chaves et al. |
| 6,030,595 | A | 2/2000 | Sumiya et al. |
| 6,050,354 | A | 4/2000 | Pessier et al. |
| 6,063,333 | A | 5/2000 | Dennis |
| 6,123,612 | A | 9/2000 | Goers |
| 6,126,741 | A | 10/2000 | Jones et al. |
| 6,202,770 | B1 | 3/2001 | Jurewicz et al. |
| 6,248,447 | B1 | 6/2001 | Griffin et al. |
| 6,269,894 | B1 | 8/2001 | Griffin |
| 6,298,930 | B1 | 10/2001 | Sinor et al. |
| 6,344,149 | B1 | 2/2002 | Oles |
| 6,401,845 | B1 | 6/2002 | Fielder |
| 6,443,248 | B2 | 9/2002 | Yong et al. |
| 6,443,249 | B2 | 9/2002 | Beuershausen et al. |
| 6,460,631 | B2 | 10/2002 | Dykstra et al. |
| 6,544,308 | B2 | 4/2003 | Griffin et al. |
| 6,562,462 | B2 | 5/2003 | Griffin et al. |
| 6,582,513 | B1 | 6/2003 | Linares et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,662 | B2 | 8/2003 | Matthias et al. |
| 6,681,098 | B2 | 1/2004 | Pfenninger et al. |
| 6,739,214 | B2 | 5/2004 | Griffin et al. |
| 6,749,033 | B2 | 6/2004 | Griffin et al. |
| 6,797,326 | B2 | 9/2004 | Griffin et al. |
| 6,811,610 | B2 | 11/2004 | Frushour et al. |
| 6,846,341 | B2 | 1/2005 | Middlemiss |
| 6,852,414 | B1 | 2/2005 | Frushour |
| 6,861,137 | B2 | 3/2005 | Griffin et al. |
| 6,878,447 | B2 | 4/2005 | Griffin et al. |
| 7,000,715 | B2 | 2/2006 | Sinor et al. |
| 7,070,635 | B2 | 7/2006 | Frushour |
| 7,316,279 | B2 | 1/2008 | Wiseman et al. |
| 7,517,588 | B2 | 4/2009 | Frushour |
| 7,595,110 | B2 | 9/2009 | Frushour |
| 7,757,791 | B2 | 7/2010 | Belnap et al. |
| 2005/0115744 | A1 | 6/2005 | Griffin et al. |
| 2007/0289223 | A1* | 12/2007 | Sung ..... 51/295 |
| 2008/0115421 | A1 | 5/2008 | Sani |
| 2008/0223623 | A1 | 9/2008 | Keshavan et al. |
| 2009/0152018 | A1 | 6/2009 | Sani |
| 2010/0032006 | A1 | 2/2010 | Basol |
| 2011/0083908 | A1 | 4/2011 | Shen et al. |

FOREIGN PATENT DOCUMENTS

| | | | |
|---|---|---|---|
| EP | 0329954 | A2 | 8/1989 |
| EP | 0462091 | A1 | 12/1991 |
| EP | 0462955 | A1 | 12/1991 |
| EP | 0480895 | A2 | 4/1992 |
| EP | 0500253 | A1 | 8/1992 |
| EP | 0595630 | A1 | 5/1994 |
| EP | 0595631 | A1 | 5/1994 |
| EP | 0612868 | A1 | 8/1994 |
| EP | 0617207 | A2 | 9/1994 |
| EP | 0671482 | A1 | 9/1995 |
| EP | 0787820 | A2 | 8/1997 |
| EP | 0860515 | A1 | 8/1998 |
| EP | 1190791 | A2 | 3/2002 |
| EP | 2048927 | A2 | 4/2009 |
| GB | 2048927 | A | 12/1980 |
| GB | 2261894 | A | 6/1993 |
| GB | 2268768 | A | 1/1994 |
| GB | 2323110 | A | 9/1998 |
| GB | 2323398 | A | 9/1998 |
| JP | 59219500 | A | 12/1984 |
| WO | 9323204 | A1 | 11/1993 |
| WO | 9634131 | A1 | 10/1996 |
| WO | 0028106 | A1 | 5/2000 |
| WO | 2004022821 | A1 | 3/2004 |

* cited by examiner

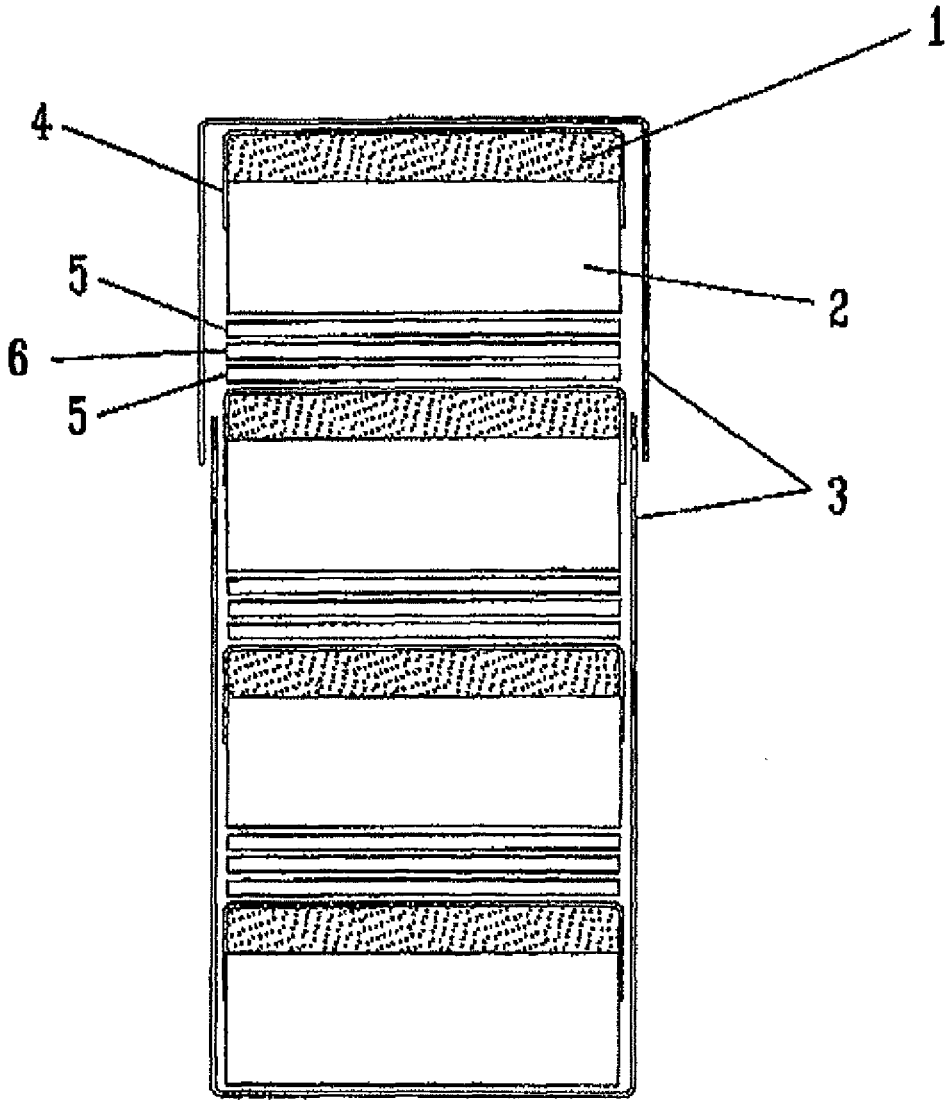
1
4
5
2
6
5
3

ADNR COMPOSITE

CROSS REFERENCE TO CO-PENDING APPLICATION

This application claims priority benefit of the U.S. Provisional Application Ser. No. 61/488,408 filed on May 20, 2011 in the name of R. Frushour, the entire contents which are incorporated herein by reference.

BACKGROUND

1. Field of the Invention

The present invention relates to an aggregated diamond nanorod, (ADNR), composite for use in rock drilling, machining of wear resistant materials, and other operations which require the high abrasion resistance or wear resistance of a surface formed with a super hard material that also has very high toughness. Specifically, this invention relates to such bodies that include a polycrystalline layer formed from ADNR attached to a cemented carbide substrate via processing at ultrahigh pressures and temperatures.

2. Description of the Art

It is well known in the art to form a polycrystalline diamond cutting element by sintering diamond particles into a compact using a high pressure, high temperature (HP/HT) press and a suitable catalyst sintering aid. Apparatus and techniques to accomplish the necessary sintering of the diamond particles are disclosed in U.S. Pat. No. 2,941,248 to Hall and U.S. Pat. No. 3,141,746 to DeLai.

U.S. Pat. No. 3,745,623 Wentorf et al. teaches sintering of the diamond mass in conjunction with tungsten carbide to produce a composite compact (PDC) in which the diamond particles are bonded directly to each other and to a cemented carbide substrate.

Typically, the diamond used to form a PDC is a mixture of various sizes of synthetic industrial grade diamond single crystals. These diamonds have very high hardness and good abrasion resistance; but lack the ability to resist fracture due to the cleavage planes arising from the well ordered crystallographic orientation of the carbon atoms within the crystal. Thus, wear is caused by micro-fracture of the diamond crystals at the cutting edge of the PDC.

It would be useful if the wear life of a compact could be extended by increasing the fracture toughness of the diamond at the cutting edge on the diamond layer of the PDC.

SUMMARY

A cutting element includes a body composed of ADNR particles where the ADNR particles are held together by covalent bonds formed using a catalyst sintering aid in a high pressure, high temperature step.

In one aspect, the average agglomerate size of the ADNR particles is larger than 40 microns and less than 500 microns.

In another aspect, the ADNR table is re-leached or otherwise treated to render the catalyst sintering aid in the interstices to bond the ADNR table to the substrate inactive to full depth leaving only that required to maintain attachment of the ADNR table to the substrate.

In another aspect, an outer portion of the ADNR table is re-leached or otherwise treated to render the catalyst sintering aid in the interstices between the ADNR particles inactive.

In one aspect, the ADNR material is a series of interconnected diamond nanorods having diameters between 5 and 20 nanometers and lengths of approximately one micrometer.

DETAILED DESCRIPTION OF THE DRAWING

The various features, advantages and other uses of the ADNR polycrystalline diamond cutting element will be come more apparent by referring to the following detailed description and drawing in which:

FIG. 1 is a pictorial representation of a high-pressure high temperature cell.

DETAILED DESCRIPTION

The present description pertains to forming a PDC including a diamond material layer composed of ADNRs bonded together with a sintering aid and bonded to a substrate under high-pressure and high-temperature. The ADNR material has a higher density and hardness than synthetic or type IIa natural diamond. The density of ADNR is approximately 0.3% greater than natural diamond and it is 11% less compressible. The Vickers micro hardness does not make an indentation on the surface of ADNR and ADNR can scratch the (111) faces of type-IIa natural diamond.

By example only, the average agglomerate size of the ADNR material is larger than 40 microns and less than 500 microns.

One method for making ADNRs is to compress carbon—60 molecules to 20 Gpa while simultaneously heating to temperatures of around 2500° Kelvin. Other methods include compressing fullerite powder to even higher pressures without the application of heat. The ADNR material is a series of interconnected diamond nanorods having diameters between about 5 and about 20 nanometers and lengths of approximately 1 micrometer. The random arrangement of the nanorods of bonded carbon atoms in the ADNR give rise to superior impact resistance or fracture toughness which results in much longer wear life of the cutting edge of a PDC made with ADNR during rock drilling. The ADNR can be substituted for the single crystals of synthetic diamond in the manufacturing of a conventional PDC. All of the other components of the high-pressure cell and the processing conditions can remain the same as those used to make any of the state of the art diamond composites used for machining wear resistant materials or for rock drilling.

In one aspect, the ADNR's are sized larger than the single crystals used to make a conventional PDC diamond layer. A conventional PDC is made with smaller size particles to improve the fracture toughness of the diamond layer. The smaller diamonds bonded together with sp3 bonds inhibit crack propagation via cleavage due to the random orientation of the crystals. The use of these small crystals results in a larger surface area of cobalt catalyst that is normally used to sinter the diamond layer being present at the cutting edge of the tool. Nowadays, this catalyst is removed by acid leaching to improve the strength of the cutting edge at the high temperatures reached while drilling. The problem caused by the use of the catalyst is reduced by the use of larger ADNR particles. Additionally if the PDC made with the larger particles of ADNR has to be leached to remove the catalyst sintering aids it can be much more easily accomplished due to the more accessible larger holes in the interconnected pore network of the diamond layer.

Generally, the ADNRs have to be crushed and sized to dimensions for good packing and to allow enough surface area to achieve good carbon to carbon bonding between the particles. Because the ADNRs are extremely difficult to crush; it is recommended that a jet milling apparatus be used, wherein the particles are accelerated towards each other in order to achieve enough impact to break down the material.

The ADNR's are typically crushed, sized and then cleaned in a hydrogen furnace for about 1 hour at 900° C. This feed stock can be used by any of the well known high pressure, high temperature manufacturing processes to produce a PDC cutter.

In the following description and claims, it should be understood the substrate is formed of a hard metal and more particularly, a cemented metal carbide substrate formed of one carbide of one of the Group IVB, VB or VIB metals which is pressed and sintered in the presence of a binder of cobalt, nickel, or iron and the alloys thereof.

Typically, the ADNR particles are bonded together to form an ADNR table and attached to a substrate with a catalyst sintering aid in a high pressure, high temperature step. The ADNR particles can also be bonded together and attached to a substrate in a high pressure, high temperature step using a non-catalyst sintering aid.

The ADNR table can be re-leached or otherwise treated to render the catalyst sintering aid in the interstices between the ADNR particles from the high pressure step used to bond the ADNR table to the substrate inactive to the full depth of the ADNR table leaving only that required to maintain attachment of the ADNR table to the substrate.

Alternately, only on outer portion of the ADNR table is re-leached or otherwise treated to render the catalyst sintering aid in the interstices between the ADNR particles inactive.

ADNR material 1 is placed into a protective metal cup 4 then a substrate, or support 2 is placed into the cup 4 on top of the diamond material 1.

An enclosure 3 is cylindrical in shape and is designed to fit within a central cavity of an ultrahigh pressure and temperature cell, such as described in U.S. Pat. No. 3,745,623 or U.S. Pat. No. 3,913,280.

The enclosure 3 is composed of a metal such as zirconium, molybdenum, or tantalum, which is selected because of its high melting temperature and designed to protect the reaction zone from moisture and other harmful impurities present in a high pressure and high temperature environment. The cup 4 is also made of a metal such as zirconium, molybdenum, or tantalum, and designed to provide additional protection to the sample if the outer enclosure should fail. Discs 5 are fabricated from either zirconium or molybdenum and disc 6 is composed of fired mica, salt, boron nitride, or zirconium oxide and is used as a separator so that composite bodies can be easily divided.

For example, the metal carbide support 2 is composed of tungsten carbide with a 13 weight percent cobalt binder.

The entire cell is subjected to pressures in excess of 40 K-bars and heated in excess of about 1400° C. for a time of about 10 minutes. Then the cell is allowed to cool enough so that the ADNR does not back-convert to graphite when the pressure is released.

After pressing, the samples are lapped and ground to remove all the protective metals of the enclosure 3, cup 5 and discs 5, and 6.

Finished parts are mounted onto tool shanks or drill bit bodies by well known methods, such as brazing, LS bonding, mechanical interference fit, etc., and find use in such applications as, machining high silicon aluminum, brass, composite materials, rock, or any application where excessive temperatures may result in thermal degradation of the diamond cutting edge,

EXAMPLE 100 carats of ADNR material with an average particle size of 50 microns is cleaned in a hydrogen atmosphere at 900° C. for one hour. The cleaned material thus produced is used as a feed stock to manufacture a PDC cutter by known high pressure, high temperature techniques.

What is claimed is:

1. A cutting element comprising:

a body composed of aggregated diamond nanorod (ADNR) particles wherein the ADNR are held together as ADNR material by covalent carbon bonds formed using a catalyst sintering aid in a high-pressure high-temperature step; and wherein the average agglomerate size of the ADNR material is larger than 40 microns.

2. A cutting element comprising:

a body composed of aggregated diamond nanorod (ADNR) particles wherein the ADNR are held together as ADNR material by covalent carbon bonds formed using a catalyst sintering aid in a high-pressure high-temperature step; and wherein the average agglomerate size of the ADNR material is less than 500 microns.

3. A cutting element comprising:

a body composed of aggregated diamond nanorod (ADNR) particles wherein the ADNR are held together as ADNR material by covalent carbon bonds formed using a catalyst sintering aid in a high-pressure high-temperature step; and wherein the ADNR particles are bonded together to form an ADNR table and attached to a substrate with a catalyst sintering aid in a high-pressure high-temperature step.

4. The cutting element of claim 3, wherein the substrate comprises a hard metal.

5. The cutting element of claim 3, wherein the substrate comprises at least one carbide formed of at least one metal of group IV, V, VB or VIB.

6. The cutting element of claim 5, wherein the carbide is pressed and sintered in the presence of a binder of at least one cobalt, nickel, iron and alloys thereof.

7. The cutting element of claim 3 wherein an outer portion of the ADNR table is re-leached or otherwise treated to render the catalyst sintering aid in the interstices between the ADNR particles inactive.

8. The cutting element of claim 3 wherein the average agglomerate size of the ADNR material is larger than 40 microns.

9. The cutting element of claim 3 wherein the average agglomerate size of the ADNR material is smaller than 500 microns.

10. The cutting element of claim 3 wherein the ADNR table is re-leached or otherwise treated to render the catalyst sintering aid in interstices between the ADNR particles from the high-pressure step used to bond the ADNR table to the substrate inactive to full depth leaving only that required to maintain attachment to the substrate.

11. The cutting element of claim 10 wherein the average agglomerate size of the ADNR material is larger than 40 microns.

12. The cutting element of claim 10 wherein the average agglomerate size of the ADNR material is smaller than 500 microns.

13. A cutting element comprising:

a body composed of aggregated diamond nanorod (ADNR) particles wherein the ADNR are held together as ADNR material by covalent carbon bonds formed using a catalyst sintering aid in a high-pressure high-temperature step; and wherein the ADNR particles is a series of interconnected diamond nanorods having diameters between about 5 and 20 nanometers and length of approximately 1 micrometer.

* * * * *